US010876429B2

(12) United States Patent
Lefebvre et al.

(10) Patent No.: US 10,876,429 B2
(45) Date of Patent: Dec. 29, 2020

(54) SHROUD SEGMENT ASSEMBLY INTERSEGMENT END GAPS CONTROL

(71) Applicant: PRATT & WHITNEY CANADA CORP., Longueuil (CA)

(72) Inventors: Guy Lefebvre, St-Bruno-de-Montarville (CA); Daniel Lecuyer, St-Bruno (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 66 days.

(21) Appl. No.: 16/360,489

(22) Filed: Mar. 21, 2019

(65) Prior Publication Data

US 2020/0300124 A1 Sep. 24, 2020

(51) Int. Cl.
*F01D 25/24* (2006.01)
*F01D 9/00* (2006.01)

(52) U.S. Cl.
CPC ..... *F01D 25/246* (2013.01); *F01D 9/00* (2013.01); *F05D 2220/32* (2013.01); *F05D 2230/60* (2013.01); *F05D 2240/14* (2013.01); *F05D 2260/30* (2013.01)

(58) Field of Classification Search
CPC . F01D 25/246; F01D 9/06; F01D 9/04; F05D 2220/32; F05D 2230/60; F05D 2240/14; F05D 2260/30
See application file for complete search history.

(56) References Cited

U.S. PATENT DOCUMENTS

| | | | | |
|---|---|---|---|---|
| 4,872,810 | A | 10/1989 | Brown et al. | |
| 5,338,154 | A | 8/1994 | Meade et al. | |
| 5,632,600 | A | 5/1997 | Hull | |
| 6,234,756 | B1 * | 5/2001 | Ress, Jr. ..... | F01D 5/30 29/525.02 |

(Continued)

FOREIGN PATENT DOCUMENTS

| | | |
|---|---|---|
| EP | 1524409 B1 | 2/2004 |
| EP | 2075721 | 7/2009 |

(Continued)

OTHER PUBLICATIONS

European Search Report dated Jul. 8, 2020 for Application No. 20165006.6.

*Primary Examiner* — Nathaniel E Wiehe
*Assistant Examiner* — Eric A Lange
(74) *Attorney, Agent, or Firm* — Norton Rose Fulbright Canada LLP

(57) ABSTRACT

An annular shroud assembly for a gas turbine engine is provided. The annular shroud assembly includes a plurality of first shroud segments having a same first arcuate length within a tolerance, at least one second shroud segment having a second arcuate length different than the first arcuate length and outside the tolerance, a plurality of first intersegment gaps between adjacent first segments, the first intersegment gaps having a circumferential dimension within a desired controlled range of dimensions, and at least two second intersegment gaps between opposed ends of the (Continued)

second segment and adjacent first segment. The first and second intersegment gaps are within the desired controlled range. Methods for controlling intersegment gaps between a plurality of shroud segments forming an annular shroud assembly and for forming such annular shroud assembly are also provided.

20 Claims, 5 Drawing Sheets

(56) References Cited

U.S. PATENT DOCUMENTS

| | | | | |
|---|---|---|---|---|
| 6,467,339 | B1 * | 10/2002 | Descoteaux | B23P 6/002 73/112.01 |
| 6,520,743 | B2 | 2/2003 | Arilla et al. | |
| 7,300,246 | B2 | 11/2007 | Durocher et al. | |
| 7,578,656 | B2 | 8/2009 | Higgins et al. | |
| 8,550,784 | B2 | 10/2013 | Malmborg et al. | |
| 8,727,735 | B2 | 5/2014 | Lee et al. | |
| 8,985,944 | B2 | 3/2015 | Shapiro et al. | |
| 9,303,521 | B2 | 4/2016 | Arnold | |
| 9,453,422 | B2 | 9/2016 | Hile et al. | |
| 9,732,618 | B2 | 8/2017 | Roussely-Rousseau et al. | |
| 9,771,802 | B2 | 9/2017 | Ross et al. | |
| 9,945,237 | B2 | 4/2018 | Partyka et al. | |
| 10,077,663 | B2 | 9/2018 | Malmborg et al. | |
| 10,221,761 | B2 | 3/2019 | Sandoval | |
| 10,253,642 | B2 | 4/2019 | Hough et al. | |
| 10,280,766 | B2 | 5/2019 | Deighton et al. | |
| 10,329,929 | B2 | 6/2019 | Oren et al. | |
| 10,370,971 | B2 | 8/2019 | Bifulco et al. | |
| 10,400,603 | B2 | 9/2019 | Hummel et al. | |
| 10,443,451 | B2 | 10/2019 | Lefebvre et al. | |
| 10,550,702 | B2 | 2/2020 | Leon et al. | |
| 2012/0063880 | A1 | 3/2012 | Nordstrom | |
| 2017/0044919 | A1 * | 2/2017 | Pietrobon | F01D 25/12 |
| 2017/0356309 | A1 * | 12/2017 | Davis | F01D 5/02 |
| 2018/0245474 | A1 | 8/2018 | Alexander | |
| 2018/0355736 | A1 | 12/2018 | Engel et al. | |
| 2019/0071984 | A1 | 3/2019 | Leon et al. | |
| 2019/0195072 | A1 | 6/2019 | Dierksmeier et al. | |
| 2020/0056491 | A1 | 2/2020 | Bailey | |

FOREIGN PATENT DOCUMENTS

| | | | |
|---|---|---|---|
| EP | 2287446 | B1 | 7/2010 |
| EP | 2964894 | B1 | 12/2013 |
| EP | 2924237 | B1 | 3/2014 |
| EP | 3000967 | B1 | 9/2015 |
| EP | 3000990 | B1 | 9/2015 |
| EP | 3018295 | | 5/2016 |
| EP | 3156605 | B1 | 9/2016 |
| FR | 2972482 | B1 | 3/2011 |
| FR | 3008912 | | 1/2015 |
| RU | 2688079 | C2 | 9/2015 |
| WO | 2013110792 | | 8/2013 |
| WO | 2019083595 | A1 | 8/2018 |

* cited by examiner

SHROUD SEGMENT ASSEMBLY INTERSEGMENT END GAPS CONTROL

TECHNICAL FIELD

The present invention relates generally to turbine or compressor sections of gas turbine engines, and more particularly to shroud assemblies therefor.

BACKGROUND

Shrouds that surround the outer tips of rotors in the turbine or compressor sections of gas turbine engines are typically formed by a plurality of arcuate shroud segments which are assembled end to end to form a circumferentially extending annular shroud assembly. The shroud segments are typically identical to one another, and are designed and assembled such that the circumferential gaps between circumferentially adjacent shroud segments, referred to as intersegment gaps, are accurately controlled. The precise dimensions of the shroud segments must therefore be maintained within very restrictive tolerances, such as to accurately control the intersegment gaps in a manner to avoid segment interference during hot running conditions while still limiting air loss through the gaps. Maintaining very restrictive tolerances during manufacturing entails increased manufacturing time and high manufacturing expenses.

SUMMARY

In one aspect, there is provided a method for assembling an annular shroud assembly of a gas turbine engine, the method comprising: assembling a plurality of non-classified shroud segments manufactured to have an arcuate length within a first arcuate length tolerance, selecting a classified shroud segment manufactured to have a calibrated arcuate length different than the arcuate length of the non-classified shroud segments, the calibrated arcuate length of the classified shroud segment manufactured within a second arcuate length tolerance more restrictive than the first arcuate length tolerance; and assembling the non-classified shroud segments and the classified shroud segment together to form the annular shroud assembly.

In another aspect, there is provided a method for controlling intersegment gaps between a plurality of shroud segments forming an annular shroud assembly, the method comprising selecting a classified shroud segment among a set of classified shroud segments, each of the classified shroud segments of the set having a different calibrated arcuate length outside, the selected classified shroud segment having an arcuate length sized to fit circumferentially between two non-classified shroud segments of the annular shroud assembly to maintain a circumferential dimension of all of the intersegment gaps of the annular shroud assembly within a controlled range.

In a further aspect, there is provided an annular shroud assembly for a gas turbine engine, the annular shroud assembly comprising a plurality of first shroud segments having a same first arcuate length within a tolerance, at least one second shroud segment having a second arcuate length different than the first arcuate length and outside the tolerance, a plurality of first intersegment gaps between adjacent first shroud segments, the first intersegment gaps having a circumferential dimension within a desired controlled range of dimensions, and at least two second intersegment gaps between opposed ends of the second segment and adjacent first segments, the first and second intersegment gaps being within the desired controlled range.

BRIEF DESCRIPTION OF THE DRAWINGS

Reference is now made to the accompanying figures in which.

DETAILED DESCRIPTION

Figure 1:
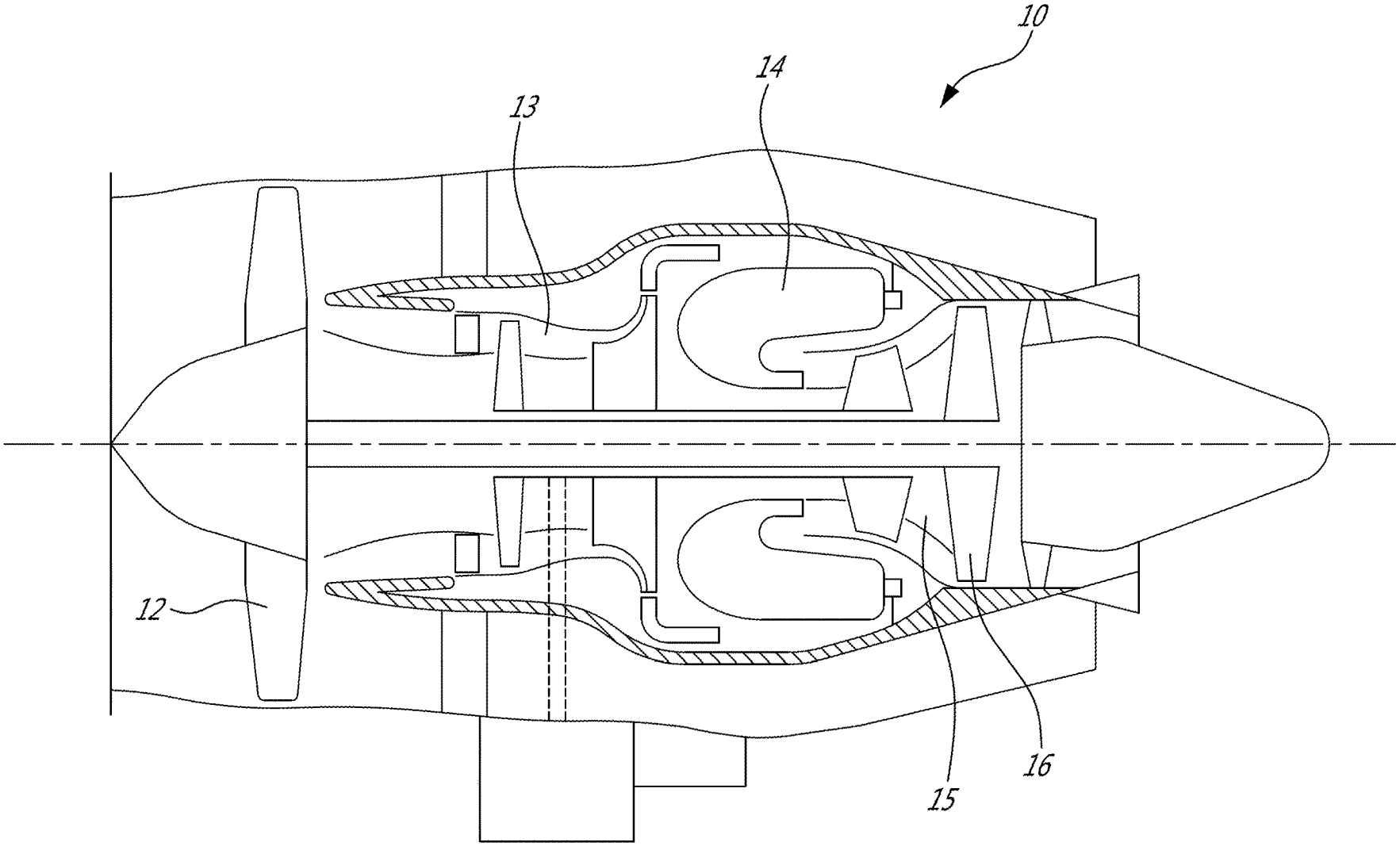
FIG. 1 is a schematic cross-sectional view of a gas turbine engine, in accordance with an embodiment.

FIG. 1 illustrates a gas turbine engine 10 of a type preferably provided for use in subsonic flight, generally comprising in serial flow communication a fan 12 through which ambient air is propelled, a compressor section 13 for pressurizing the air, a combustor 14 in which the compressed air is mixed with fuel and ignited for generating an annular stream of hot combustion gases, and a turbine section 15 for extracting energy from the combustion gases.

Figure 2:
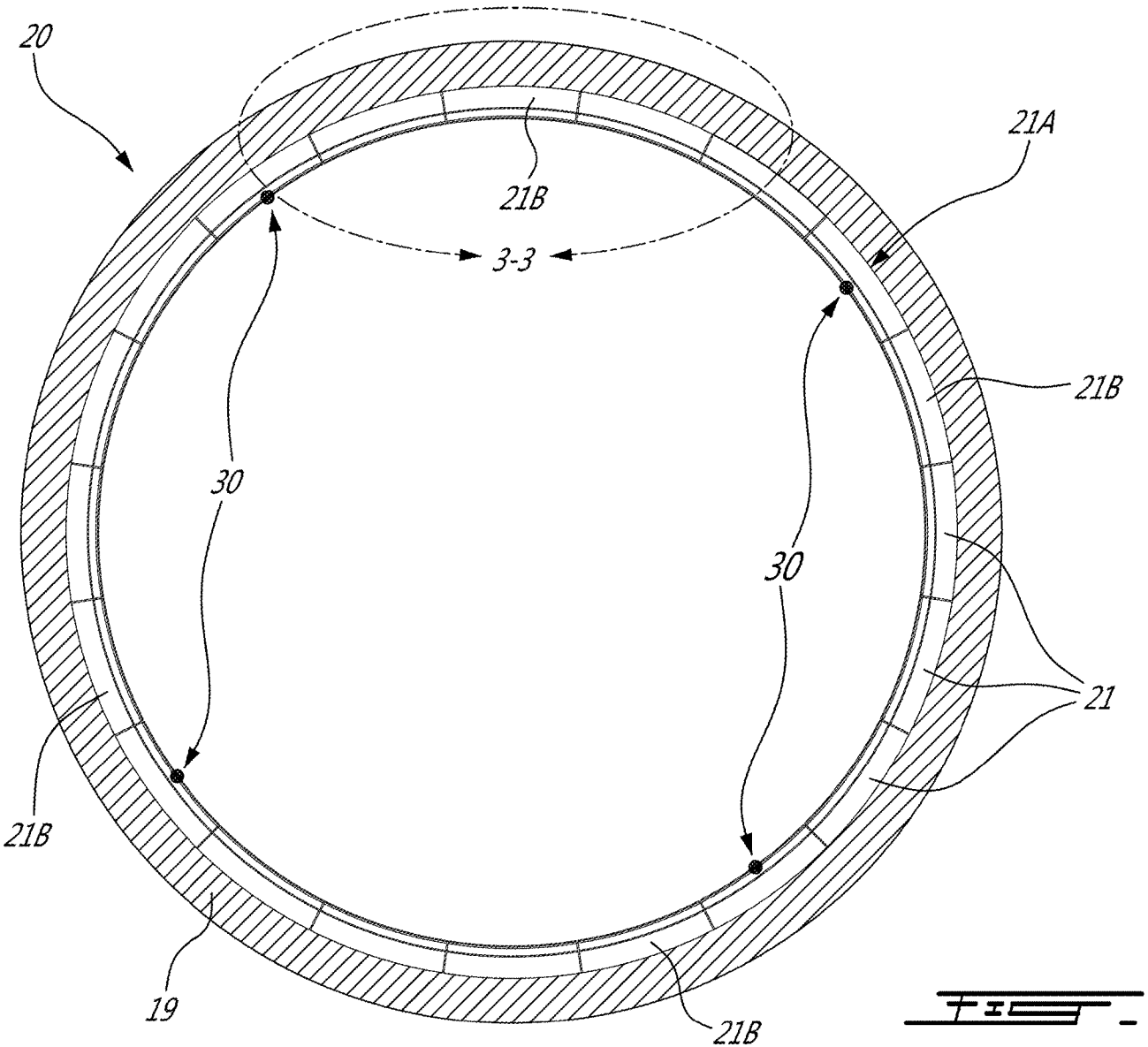
FIG. 2 is a frontal cross-sectional view of a schematic shroud assembly, as used in the gas turbine engine of FIG. 1, in accordance with an embodiment.

The turbine section 15 generally comprises one or more stages of rotors each having a plurality of rotor blades 16 extending radially outwardly from respective rotor disks, with the blade tips being disposed within an annular shroud 20 supported by a casing 19 (schematically shown in FIG. 2). The annular shroud 20 includes a plurality of shroud segments 21 disposed circumferentially one adjacent to another to jointly form an outer radial gas path boundary for the air or hot combustion gases flowing through the stages of rotor blades 16. The shroud 20 is thus sometimes referred to as a shroud assembly 20.

The shroud assembly 20 as described herein may be a compressor shroud of the compressor section 13 or turbine shroud of the turbine section 15. A cross-sectional view of an example of a shroud 20 having such plurality of shroud segments 21 is illustrated in FIGS. 2 and 3.

Figure 3:
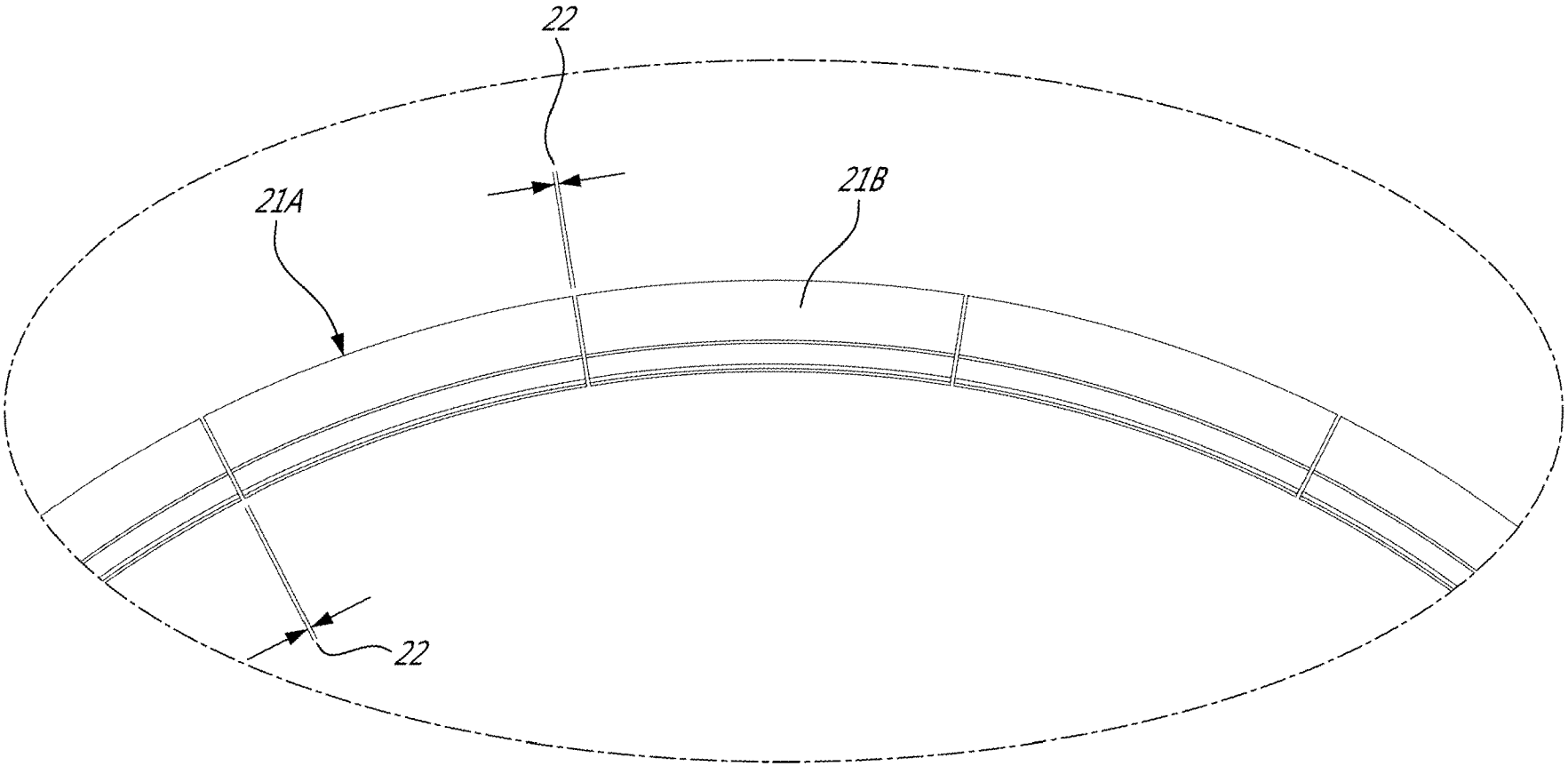
FIG. 3 is a detailed frontal cross-sectional view of the schematic shroud assembly, taken from region 3 in FIG. 2.

Referring to FIGS. 2 and 3, the shroud assembly 20 is, when assembled, annular in shape and therefore will be referred to as an annular shroud assembly 20. The annular shroud assembly 20 is comprised of a plurality of shroud segments 21 between which are defined intersegment gaps 22. The intersegment gaps 22 define a circumferential spacing or gap between facing ends of adjacent shroud segments 21. The intersegment gaps 22 extend radially a complete radial thickness of the shroud 20, between radially inner and radially outer surfaces thereof. During operation of the engine 10, the shroud segments 21 may thermally expand due to hot combustion gases flowing through the stages of the rotor blades 16. As such, the intersegment gaps 22 may allow for thermal expansion of the shroud segments 21 to occur while avoiding shroud segments 21 interference, which may cause undue thermal stresses in the segments 21 if they interfere with each other during hot running conditions. A precise circumferential dimension of such intersegment gaps 22 should thus be maintained with a controlled range, such as to allow the thermal expansion of the shroud segments 21 while concurrently limit air and/or combustion gas loss through the intersegment gaps 22 while the engine 10 is running. While the engine 10 may have optional feather seals (not shown) interconnecting ends of adjacent shroud segments 21 to seal the intersegment gaps 22 in some embodiments, it may become even more important to restrict the gap dimensions within a controlled range in embodiments where such feather seals are absent.

In order to control the circumferential dimension of the intersegment gaps 22, precise (i.e. precise or very restrictive) tolerances may be maintained during the manufacturing of the shroud segments 21 that will be jointly assembled to form the shroud 20. Any suitable manufacturing process may be used to make the shroud segments 21 within a desired tolerance. As understood, manufacturing shroud segments 21 with less restrictive ("relaxed") tolerances (or "less-precisely" manufactured shroud segments 21), at least on their arcuate length and/or their end surfaces defining therebetween the intersegment gaps 22, may advantageously take less time to manufacture and/or decrease the manufacturing expenses tied to high precision manufacturing. For instance, this may be due to the use of more cost-effective tooling and/or more time-efficient manufacturing method(s) or process(es).

Typically, to ensure the intersegment gaps 22 were uniform in circumferential dimension and maintained within a controlled range, all the shroud segments 21 of the annular shroud assembly 20 had to have a substantially uniform arcuate length within a restrictive tolerance. Such former approach may have the disadvantage of involving increased cost and/or time in connection with the manufacturing of all the shroud segments 21 of the annular shroud assembly 20. The present disclosure provides a different approach. The present approach may permit relaxing the manufacturing tolerances of a majority of the shroud segments 21, and accordingly help to reduce manufacturing expenses, while still conforming to the engine build end gap build clearance requirements.

An annular shroud assembly 20 is formed using a plurality of shroud segments 21, and more particularly, a plurality of non-classified shroud segments 21A and a classified shroud segment 21B. The non-classified shroud segments 21A are manufactured within a first, less restrictive tolerance (i.e. more "relaxed" tolerance). The term non-classified shroud segment 21A may refer to shroud segments 21 manufactured with a more relaxed tolerances, at least along their arcuate length and/or their end surfaces. For instance, in an embodiment, the non-classified shroud segments 21A are characterized by a first arcuate length tolerance selected such as to provide intersegment gaps 22 of about 3 mil (i.e. 3 thousands of an inch, or 0.001 inch, or 0.0254 mm)±1.5 mil. The first arcuate length tolerance may have any other suitable values. Having a less restrictive arcuate length or end surface tolerance value for the non-classified shroud segments 21A may reduce manufacturing time and expenses, for instance.

In some cases, all the non-classified segments 21A of the annular shroud assembly 20 may have the same arcuate length within an arcuate length tolerance. This may help during assembly, as the segments 21 may be interchangeable without compromising the engine 10 operation or assembly. In other words the non-classified shroud segments 21A forming the annular shroud assembly 20 may not have an allocated position along the circumference of the annular shroud assembly 20, though in other embodiments each non-classified shroud segment 21A may have a specific position predetermined at the outset.

Due to the greater variability of the arcuate length of the non-classified shroud segments 21A, the annular shroud assembly 20 composed of a plurality of non-classified shroud segments 21A may result in having insufficient intersegment gaps dimension to ensure the shroud segments 21 may thermally expand in hot conditions during operation of the engine 10 while minimizing these intersegment gaps 22 dimension between adjacent shroud segments 21 to limit air/combustion gas loss through the gaps 22 when the thermal expansion has not resulted into contact of adjacent shroud segments 21. In other words, because of the variations of arcuate length of the non-classified shroud segments 21A within a less restrictive manufacturing tolerance, there may have the need for at least one shroud segment 21, which will be referred to as the "classified" shroud segment 21B, that has an arcuate length and/or an end surface tolerance different than that of the other shroud segments 21, in order to keep the intersegment gaps 22 between each adjacent shroud segment 21 within a desired controlled range. In practice, such range must be controlled to limit the circumferential dimensions of the gaps 22 to a suitable dimension allowing the shroud segments 21 to thermally expand during operation of the engine 10, without causing interference between adjacent segments 21. In other words, the intersegment gaps 22 dimension may be controlled to be set within a controlled range providing enough intersegment space to allow thermal expansion of the segments 21 during operation of the engine 10 and concurrently limit the gaps 22 dimension when the engine 10 is running and the segments 21 are thermally expanded at a steady state during the running of the engine 10 (i.e. their arcuate length may remain substantially constant during normal running conditions of the engine 10). For instance, in an embodiment, the controlled range of intersegment gaps dimension may be from 1.5 mil to 4.5 mil (i.e. 3 mil±1.5 mil). The controlled range may be different in other embodiments.

The classified shroud segment 21B is manufactured within a second, more restrictive, tolerance (i.e. a tolerance more restrictive than the first tolerance on the arcuate length of the non-classified shroud segments 21A). As such, the arcuate length of the classified shroud segment 21B may by referred to as a "calibrated" arcuate length due to its precise arcuate length with restrictive manufacturing tolerances. The calibrated arcuate length tolerance is more restrictive than the arcuate length tolerance of the non-classified shroud segments 21A. In a particular embodiment, the calibrated arcuate length tolerance of the classified shroud segment 21B is more restrictive than ±1.5 mil. For instance, in some cases, the calibrated arcuate length tolerance ranges from ±0.5 mil to ±1.5 mil (±1.5 mil excluded). In some cases, a ratio of the arcuate length tolerance of the non-classified shroud segments 21A over the calibrated arcuate length tolerance may range from 2 to 6. This ratio may be different in other embodiments, where, for instance, the calibrated arcuate length tolerance is even more restrictive than the arcuate length tolerance of the non-classified shroud segments 21A.

Figure 4:
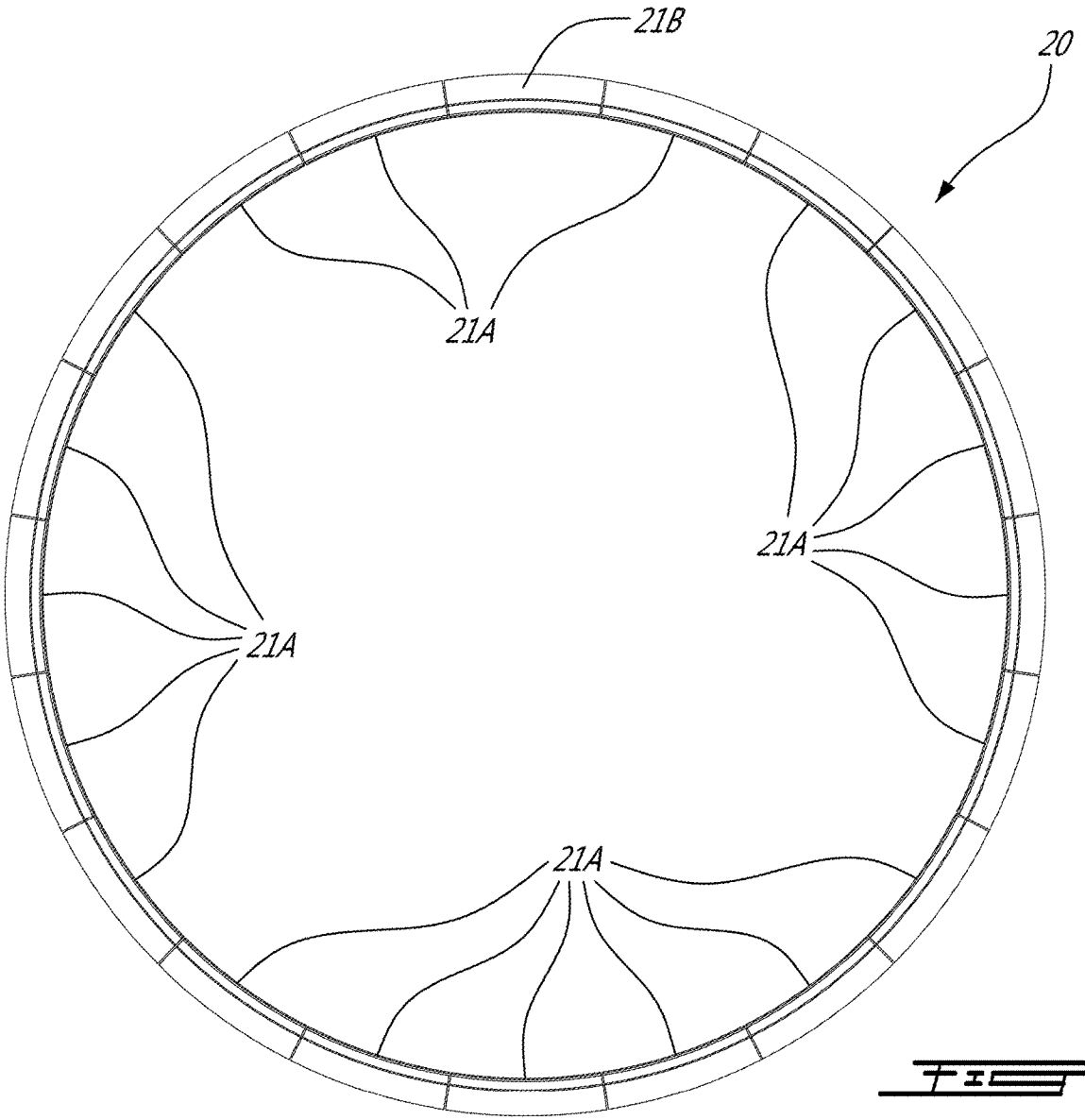
FIGS. 4-5 are illustrations of variants of the shroud assembly shown in FIGS. 1-3.

A plurality of non-classified shroud segments 21A and a classified shroud segment 21B may thus be obtained. The non-classified shroud segments 21A and the classified shroud segment 21B may then be assembled adjacent each other in the casing 19 to form the annular shroud assembly 20. In other words, the classified shroud segment 21B may be located circumferentially between two of the non-classified shroud segments 21A. In embodiments where the annular shroud assembly 20 has multiple serial disk stages, assembling the non-classified shroud segments 21A and the classified shroud segment 21B may form a first one of the disk stages, for instance. In an embodiment, the annular shroud assembly 20 has at least one classified segment for each turbine disk stage. In an embodiment, such as shown in FIG. 4, the shroud annular assembly 20 has a single classified shroud segment 21B, and all other shroud segments 21 of the annular shroud assembly 20 (or at least a same disk stage of the annular shroud assembly 20, for instance) may be non-classified shroud assembly 21A. Although shown in a specific position about the circumference of the annular shroud assembly 20 on FIG. 4, the position of the classified shroud segment 21B may be anywhere else around the circumference of the annular shroud assembly 20. This may be different in other embodiments, where, for instance, all the segments of the annular shroud assembly 20 for a disk stage may be non-classified shroud segments 21A.

Once assembled, the annular shroud assembly 20 defines a plurality of intersegment gaps 22 between adjacent non-classified shroud segments 21A, and/or between opposed ends of the classified shroud segment 21B and adjacent non-classified shroud segments 21A. For convenience, the intersegments gaps 22 between adjacent non-classified shroud segments 21A will be referred to as the first intersegment gaps 22, and the intersegment gaps 22 between opposed ends of the classified shroud segment 21B and adjacent non-classified shroud segments 21A will be referred to as the second intersegment gaps 22. In an embodiment, the first and second intersegments gaps 22 are substantially uniform and maintained within the controlled range. The substantial uniformity of the gaps 22 implies a degree of variation that allows maintaining their respective dimension along the circumference of the annular shroud assembly 20 within the controlled range.

The classified shroud segment 21B for assembling into the annular shroud assembly 20 is optimally selected so that the intersegment gaps 22 may be substantially uniform between each adjacent segments (classified and non-classified segments), and more particularly, substantially uniformly dimensioned within the controlled range. As such, the intersegment gaps 22 may be minimized while the engine 10 is warmed up and running at a steady state, for instance. The selection of the suitably sized classified shroud segment 21B may be made from a set of classified shroud segments 21B. Such set may be part of a kit of classified shroud segments 21B produced to comprise a plurality of classified shroud segments 21B having different calibrated arcuate length. This will be discussed later in more details. In order to select the classified shroud segment 21B to form the annular shroud assembly 20 that will ensure the intersegment gaps 22 are maintained within the controlled range, the non-classified shroud segments 21A may be assembled in the casing 19, and a circumferential space allocated for a classified shroud segment 21B between two non-classified shroud segments 21A may be measured using known high-precision measuring techniques. The classified shroud segment 21B may then be selected among the set of classified shroud segments 21B, where the calibrated arcuate length of the selected classified shroud segment 21B correspond to the circumferential space allocated for it (minus the required intersegment gaps dimension at opposed ends thereof once installed). Thus, the first intersegment gap 22 defined between adjacent non-classified shroud segments 21A and two second intersegment gaps 22 defined between opposed ends of the classified shroud segment 21B and adjacent non-classified shroud segments 21A may be maintained within the controlled range.

In some embodiments, the annular shroud assembly 20 may have a number of retention pins 30 for fixing the position of a corresponding number of shroud segments 21. In such embodiments, the annular shroud assembly 20 may comprise a number of classified shroud segments 21B that correspond to the number of retention pins 30 to control the intersegment gaps 22 between adjacent shroud segments 21 aligned along the circumference of the casing 19 of the annular shroud assembly 20, extending between adjacent retention pins 30. For instance, if the annular shroud assembly 20 comprises four retention pins 30 for retaining four non-classified shroud segments 21A in place along the circumference of the casing 19, there will be selected at least four classified shroud segments 21B, each for being mounted between adjacent non-classified shroud segments 21A along the circumference of the casing 19, in between adjacent retention pins 30, respectively. Such example is shown, in FIG. 2. A different number of retention pins 30, fixed non-classified shroud segments 21A and/or classified shroud segments 21B may be contemplated in other embodiments.

The approach herein described may thus provide a method for controlling intersegment gaps 22 between a plurality of shroud segments 21 that form a annular shroud assembly 20. Such method comprises selecting at least one classified shroud segment 21B among a set of classified shroud segments 21B, where each of the classified shroud segments 21B of the set may have a different calibrated arcuate length. The selected classified shroud segment 21B may be selected having regard to its arcuate length, i.e. a calibrated arcuate length manufactured within a very restrictive arcuate length tolerance, and which may have the size suitable to fit circumferentially between two non-classified shroud segments 21A mountable to the casing 19 of the annular shroud assembly 20 when mounted to such casing 19, to maintain a circumferential dimension of all of the intersegment gaps 22, i.e. the intersegments gaps 22 between adjacent non-classified shroud segments 21A and the intersegment gaps 22 between opposed ends of the classified shroud segment 21B and adjacent non-classified shroud segments 21A, within the controlled range.

Figure 5:
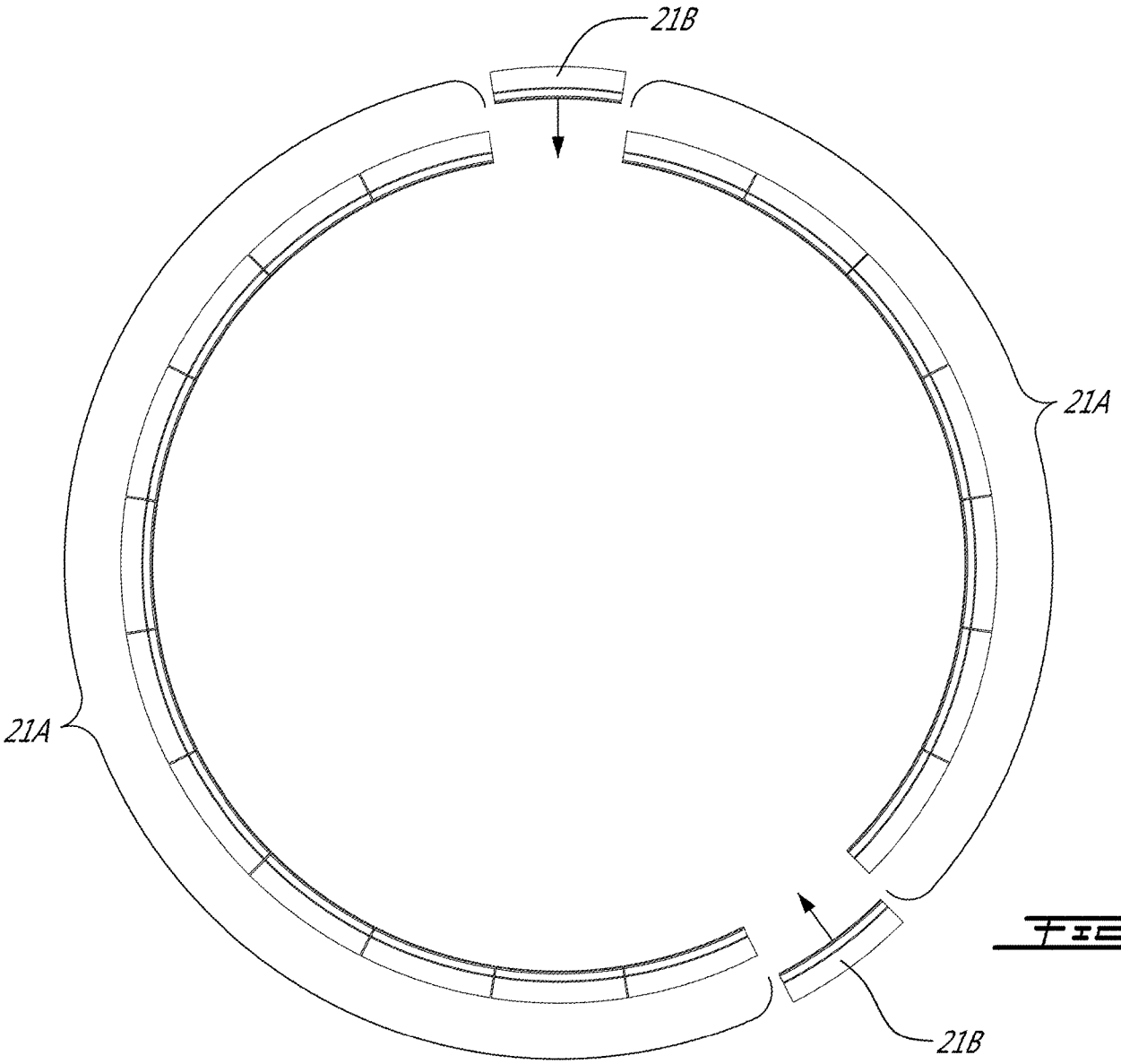

As previously discussed, a circumferential space allocated for the classified shroud segment 21B between two non-classified shroud segments 21A may be measured prior to selecting the classified shroud segment 21B among the set. The selection of the suitable classified shroud segment 21B will thus be made with regard to its calibrated arcuate length having the right size to fit the circumferential space allocated for the classified segment while allowing the intersegment gaps 22 to be maintained within the controlled range, as discussed above. In some embodiments, there may need more than one classified shroud segments 21B, for a number of reasons, including some reasons already discussed. As such, one may select at least a first and a second classified shroud segments 21B, which may or may not have a different calibrated arcuate length. That is, each of the selected classified shroud segments 21B may be selected to suitably fit in a corresponding allocated space along the circumference of the casing 19, which may or may not be for a same disk stage of the shroud 20, if applicable. This is shown in FIG. 5, for instance.

The set of classified shroud segments 21B may include classified shroud segments 21B having respective calibrated arcuate lengths. In some cases, the calibrated arcuate lengths of at least one of the classified shroud segments 21B among the set may differ from at least another one of the classified shroud segments 21B by an incremental value of no more than 0.5 mil. In some embodiments, it may be advantageous to have such incremental calibrated lengths within the set of classified shroud segments 21B to allow flexibility during the assembly of the annular shroud assembly 20 and provide a suitably sized classified shroud segment 21B for many manufacturing and assembly cases.

As mentioned previously, another aspect of the present disclosure is a kit of shroud segments 21 for a annular shroud assembly 20 formed by a majority of non-classified shroud segments 21A which have a common arcuate length within a tolerance. In an embodiment, the kit comprises a number of classified shroud segments 21B having different calibrated arcuate lengths. In an embodiment, at least one of the classified shroud segments 21B has a calibrated arcuate length different from the common arcuate length of the non-classified shroud segments 21A. As previously discussed, the common arcuate length of the non-classified segments 21A is within a tolerance less restrictive than the manufacturing tolerance of the classified shroud segments 21B. The calibrated arcuate length being different from the common arcuate length may thus mean that the calibrated arcuate length is different from the common arcuate length and outside the manufacturing tolerance of the common arcuate length, in some embodiments. In an embodiment, each one of the classified shroud segments 21B constituting the kit has a respective calibrated arcuate length different from the calibrated arcuate lengths of the other ones of the classified shroud segments 21B of the kit. This may be different in other embodiments, where, for instance, at least some of the classified shroud segments 21B of the kit may have the same calibrated arcuate length, such that a kit may comprise duplicates of a specific classified shroud segment 21B, for instance. In a particular embodiment, there may be three or more classified shroud segments 21B in the kit, although only two classified shroud segments 21B may also be desirable in other embodiments.

In an embodiment, the calibrated arcuate lengths of at least some of the classified shroud segments 21B of the kit may differ from two other ones of the classified shroud segments 21B of the kit by no more than 0.5 mil, and in some other cases no more than 1 mil. More particularly, in some cases, the calibrated arcuate length of a respective one of the classified shroud segments 21B may differ from the calibrated arcuate length of at least one other classified shroud segment 21B by an incremental value of no more than 1 mil, and in some other cases no more than 0.5 mil.

The above description is meant to be exemplary only, and one skilled in the art will recognize that changes may be made to the embodiments described without departing from the scope of the disclosure. For example, the shroud 20 may be a compressor shroud instead of a turbine shroud, as mentioned. The shroud segments 21, either classified shroud segments 21B or non-classified shroud segments 21A, should thus be considered applicable to a compressor shroud in the compressor section 13 of the engine 10, with suitable modifications to fit within the compressor section 13 for making the compressor shroud, in its entirety or in at least one compressor stage of the engine 10. The non-classified 21A and/or classified shroud segments 21B may or may not have the same thicknesses, and/or other dimensions than their arcuate lengths. Although the intersegment gaps 22 were described as being substantially uniform for all the annular shroud assembly 20, there may be variants of the annular shroud assembly 20 where the intersegments gaps 22 between selected shroud segments 21, and/or at different positions/locations within the annular shroud assembly 20 may be purposively different. Although described with respect to a gas turbine engine 10, the present invention may also be applicable in connection with other types of engines commonly used for aircrafts and/or other transports where shroud assemblies would be applicable. Still other modifications which fall within the scope of the present invention will be apparent to those skilled in the art, in light of a review of this disclosure, and such modifications are intended to fall within the appended claims.

The invention claimed is:

1. A method for assembling an annular shroud assembly of a gas turbine engine, the method comprising: assembling a plurality of non-classified shroud segments manufactured to have an arcuate length within a first arcuate length tolerance, selecting a classified shroud segment manufactured to have a calibrated arcuate length different than the arcuate length of the non-classified shroud segments, the calibrated arcuate length of the classified shroud segment manufactured within a second arcuate length tolerance more restrictive than the first arcuate length tolerance; and assembling the non-classified shroud segments and the classified shroud segment together to form the annular shroud assembly.

2. The method as defined in claim 1, wherein the step of assembling the non-classified shroud segments and the classified shroud segment together includes locating the classified shroud segment circumferentially between two of the non-classified shroud segments.

3. The method as defined in claim 1, wherein the step of assembling the plurality of non-classified shroud segments include obtaining a plurality of first intersegment gaps between adjacent non-classified shroud segments, and the step of assembling the classified shroud segment includes obtaining at least two second intersegment gaps between opposed ends of the classified shroud segment and two non-classified shroud segments circumferentially adjacent the classified shroud segment, the first and second intersegments gaps being substantially uniform about the annular shroud assembly.

4. The method as defined in claim 2, further comprising maintaining the first and second intersegment gaps within a controlled range.

5. The method as defined in claim 4, wherein the controlled range is maintained from 1.5 mil to 4.5 mil.

6. The method as defined in claim 2, comprising measuring a circumferential space allocated for the classified shroud segment between said two of the non-classified shroud segments and selecting the classified shroud segment among a set of classified shroud segments, wherein the calibrated arc length of the selected classified shroud segment correspond to the circumferential space allocated for the classified segment.

7. The method as defined in claim 1, wherein the non-classified shroud segment is manufactured within the first arcuate length tolerance equal or less restrictive than ±1.5 mil and the classified shroud segments are manufactured within the second arcuate length tolerance more restrictive than ±1.5 mil.

8. The method as defined in claim 1, wherein the non-classified shroud segments and the classified shroud segment are manufactured such that a ratio of the first arcuate length tolerance over the second arcuate length tolerance ranges from 2 to 6.

9. The method as defined in claim 1, the method further comprising installing a number of retention pins in the annular shroud assembly to secure in place a corresponding number of non-classified shroud segments, wherein one of the classified shroud segments is disposed between each pair of the retention pins.

10. A method for controlling intersegment gaps between a plurality of shroud segments forming an annular shroud assembly, the method comprising selecting a classified shroud segment among a set of classified shroud segments, each of the classified shroud segments of the set having a different calibrated arcuate length outside, the selected classified shroud segment having an arcuate length sized to fit circumferentially between two non-classified shroud segments of the annular shroud assembly to maintain a circumferential dimension of all of the intersegment gaps of the annular shroud assembly within a controlled range.

11. The method as defined in claim 10, further comprising measuring a circumferential space allocated for the classified shroud segment between two non-classified shroud segments prior to selecting the classified shroud segment among the set, selecting the calibrated arcuate length of the selected classified shroud segment to correspond to the circumferential space allocated for the classified segment, and maintaining a first intersegment gap and second intersegment gaps within the controlled range, wherein the first intersegment gap is defined between adjacent non-classified shroud segments and two of the second intersegment gaps are defined between opposed ends of the classified shroud segment and adjacent non-classified shroud segments.

12. The method as defined in claim 11, wherein the step of maintaining the intersegment gaps within the controlled range includes having the first intersegment gap and the second intersegment gaps ranging from 1.5 mil to 4.5 mil.

13. The method as defined in claim 11, wherein the classified shroud segment is a first one of the classified shroud segments, the method further comprising selecting a second one of the classified shroud segments, wherein the calibrated arcuate lengths of the first and second ones of the classified shroud segments are different.

14. An annular shroud assembly for a gas turbine engine, the annular shroud assembly comprising a plurality of first shroud segments having a same first arcuate length within a tolerance, at least one second shroud segment having a second arcuate length different than the first arcuate length and outside the tolerance, a plurality of first intersegment gaps between adjacent first shroud segments, the first intersegment gaps having a circumferential dimension within a desired controlled range of dimensions, and at least two second intersegment gaps between opposed ends of the second segment and adjacent first segments, the first and second intersegment gaps being within the desired controlled range.

15. The annular shroud assembly as defined in claim 14, wherein the first and second intersegment gaps are substantially uniform.

16. The annular shroud assembly as defined in claim 14, wherein the second shroud segment is selected from a set of classified shroud segments having different calibrated arcuate lengths, at least one of the classified shroud segments having a calibrated length causing the first and second intersegments gaps of the annular shroud assembly to be maintained within the controlled range.

17. The annular shroud assembly as defined in claim 14, wherein the annular shroud assembly has a number of retention pins to secure in place a corresponding number of the first shroud segments, and one classified shroud segment is disposed between each pair of the retention pins.

18. The annular shroud assembly as defined in claim 14, wherein the annular shroud assembly has a plurality of serial stages, each stage having a plurality of the first shroud segments and at least one second shroud segment.

19. The annular shroud assembly as defined in claim 14, wherein the first shroud segments each have an allocated position about the circumference of the annular shroud assembly.

20. The annular shroud assembly as defined in claim 14, wherein the annular shroud assembly is a turbine shroud assembly of a turbine section of the engine.

* * * * *